US005564783A

United States Patent [19]

Elzenbeck et al.

[11] Patent Number: 5,564,783

[45] Date of Patent: Oct. 15, 1996

[54] CHAIR, IN PARTICULAR OFFICE CHAIR

[75] Inventors: Manfred Elzenbeck, Steinheim/Murr; Klaus Haar, Weinstadt; Harald Nathmann, Worms, all of Germany

[73] Assignee: Duphin Entwicklungs-u. Beteiligungs-GmbH, Neukirchen, Germany

[21] Appl. No.: 277,295

[22] Filed: Jul. 21, 1994

[30] Foreign Application Priority Data

Jul. 22, 1993 [DE] Germany ..... 43 24 541.2

[51] Int. Cl.[6] ..... A47C 3/00

[52] U.S. Cl. ..... 297/300.2; 297/300.5; 297/300.6; 297/303.4

[58] Field of Search ..... 297/300, 301, 297/304, 305, 337–339, 300.1, 300.2, 300.5, 303.1, 303.4, 303.5, 463.1

[56] References Cited

U.S. PATENT DOCUMENTS

| | | | |
|---|---|---|---|
| 3,441,311 | 4/1969 | Doerner | 297/305 |
| 3,656,593 | 4/1972 | Bauer . | |
| 4,200,332 | 4/1980 | Bränning . | |
| 4,653,806 | 3/1987 | Willi . | |
| 4,707,029 | 11/1987 | Korn | 297/300 |
| 4,709,962 | 12/1987 | Steinmann | 297/301 |
| 4,743,065 | 5/1988 | Meiller et al. | 297/301 X |

FOREIGN PATENT DOCUMENTS

| | | | |
|---|---|---|---|
| 250995 | 1/1988 | European Pat. Off. | 297/301 |
| 692359 | 11/1930 | France | 297/339 |
| 2533428 | 3/1984 | France | 297/301 |
| 4023607 | 7/1990 | Germany . | |
| 9006925 | 12/1990 | Germany . | |

*Primary Examiner*—Milton Nelson, Jr.
*Attorney, Agent, or Firm*—Browdy and Neimark

[57] ABSTRACT

A chair has a chair column on which a front seat support member is fixed. A rear seat support member provided with a back-rest support for a back-rest is joined to the front seat support member by a pivot axle. A seat is supported on the two seat support members. The seat is supported in relation to the rear seat support member by a supporting axle, which is adjustable in height relative to the rear seat support member by a seat pitch adjuster. The seat pitch adjuster can be a retrofit kit.

16 Claims, 6 Drawing Sheets

26
22
30
29
20
35
19
21
27
IV
23
V
28
19'
9
20'
32
25
24
33
31
34
48
6
8
5
7
4
50
49
54
51
37
36
42
43
41
39
68
66
62
61
67
67a
40
38
IV
V
28
67
66
61
64
62
68
67a
70
69
65
6
58
8
7
53
63
37
18

CHAIR, IN PARTICULAR OFFICE CHAIR

BACKGROUND OF THE INVENTION

1. Field of the Invention

The invention relates to a chair, in particular an office chair, comprising a pedestal, a chair column projecting upwards from the pedestal, a seat support supported on the chair column and having a front seat support member joined to the chair column and a rear seat support member joined to the front seat support member by way of a pivot ale, a seat pivotably supported on the seat support members, a back-rest secured to the rear seat support member, an energy storing device, of which one end is positioned on the front seat support member and of which the other end is positioned on the rear seat support member at a distance from the pivot axle, and a blocking mechanism for arresting the rear seat support member in relation to the front seat support member.

2. Background Art

A chair of the generic type known from U.S. Pat. No. 4,200,332 has a so-called synchronous mechanism, in which the back and the seat are simultaneously pivoted in a certain pre-set relation. The energy storing device serves to make the adjustment or pivoting of the back possible in that the user presses against the back. Upon this, the rear portion of the seat is lowered or, it is raised if the back is pivoted forwards. A longitudinally adjustable gas spring to be fixed in any desired adjustment of length is provided for fixing the back and the seat in a position. This requires some expenditure. In addition, the seat and the back have a fixed position relative to each other for each position of pivoting of the synchronous mechanism. However, this does not meet the requirements of users of different build and attitude when using the chair.

SUMMARY OF THE INVENTION

It is an object of the invention to embody a chair of the generic type such that an adaption to different anatomies and working attitudes of the user is possible with a simple structure.

In accordance with the invention, this object is solved by the seat being supported in relation to the rear seat support member by a supporting axle which is adjustable in height relative to the rear seat support member by means of a seat pitch adjuster.

The measures according to the invention ensure that the basic pitch of the seat is varied, i.e. the basic adjustment of the pitch of the seat in relation to the back-rest is variable. In this case, the position of the front portion of the seat is not changed, but the rear portion of the seat is raised or lowered.

The seat pitch adjuster can be used in the way of a kit for the subsequent equipment of the chair and the chair will keep its synchronous mechanism without this seat pitch adjuster.

An example of embodiment of the invention will be specified below taken in conjunction with the drawing.

BRIEF DESCRIPTION OF THE DRAWING

FIG. 7 is a partial plan view of the seat pitch adjuster in accordance with the arrow VIII of FIG. 7.

DESCRIPTION OF THE PREFERRED EMBODIMENT

Figure 1:
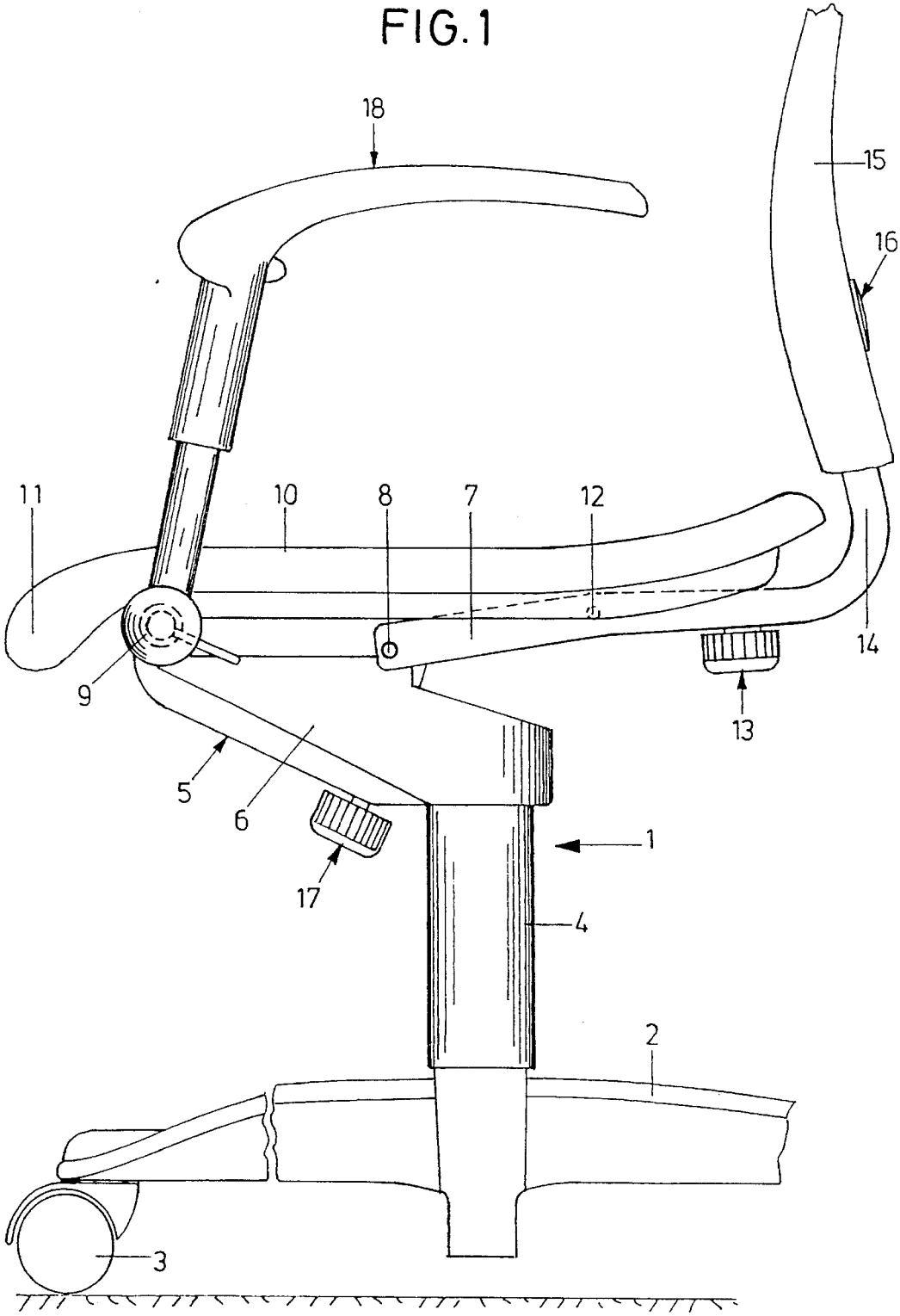
FIG. 1 is a perspective overall view of a chair.

FIG. 1 illustrates an office chair having a chair stand 1. The latter is provided with a pedestal 2 supported by castors 3 on the ground. An adjustable height chair column 4 is installed on the pedestal and has a seat support 5, also referred to herein as a cantilever brace, secured to its upper end. The seat support 5 is of twopiece design; it has a front seat support member 6 mounted on the chair column 4 and a rear seat support member 7 articulated on the front seat support member above the chair column 4 by means of a pivot axle 8. A suspension tube 9 extending parallel to the pivot axle 8 is secured in the front portion of the front seat support member 6. Right behind its front edge 11, a seat 10 supports itself on this suspension tube 9. The rear portion of the seat 10 is supported on a supporting axle 12 positioned in the rear seat support member 7. Further, a seat pitch adjuster 13 can be arranged on the rear seat support member 7.

A back-rest support 14, on which a back-rest 15 is arranged, is formed in one piece with the rear seat support member 7 and projects upwards from the latter. A back-rest height adjuster 16 is provided for the height of the back-rest 15 to be adjusted in relation to the seat 10.

The specified configuration of the seat support 5 with the arrangement of the seat 10 and the back 15 forms a so-called synchronous mechanism. A force variation equipment 17 is provided for the forces to be varied that are to be overcome during adjustment or balancing. Armrests 18, of which only one is to be seen in the lateral view of FIG. 1, are arranged adjacent to the front edge 11 of the seat 10, namely on the outer ends of the suspension tube 9.

Figures 2, 3, 5:
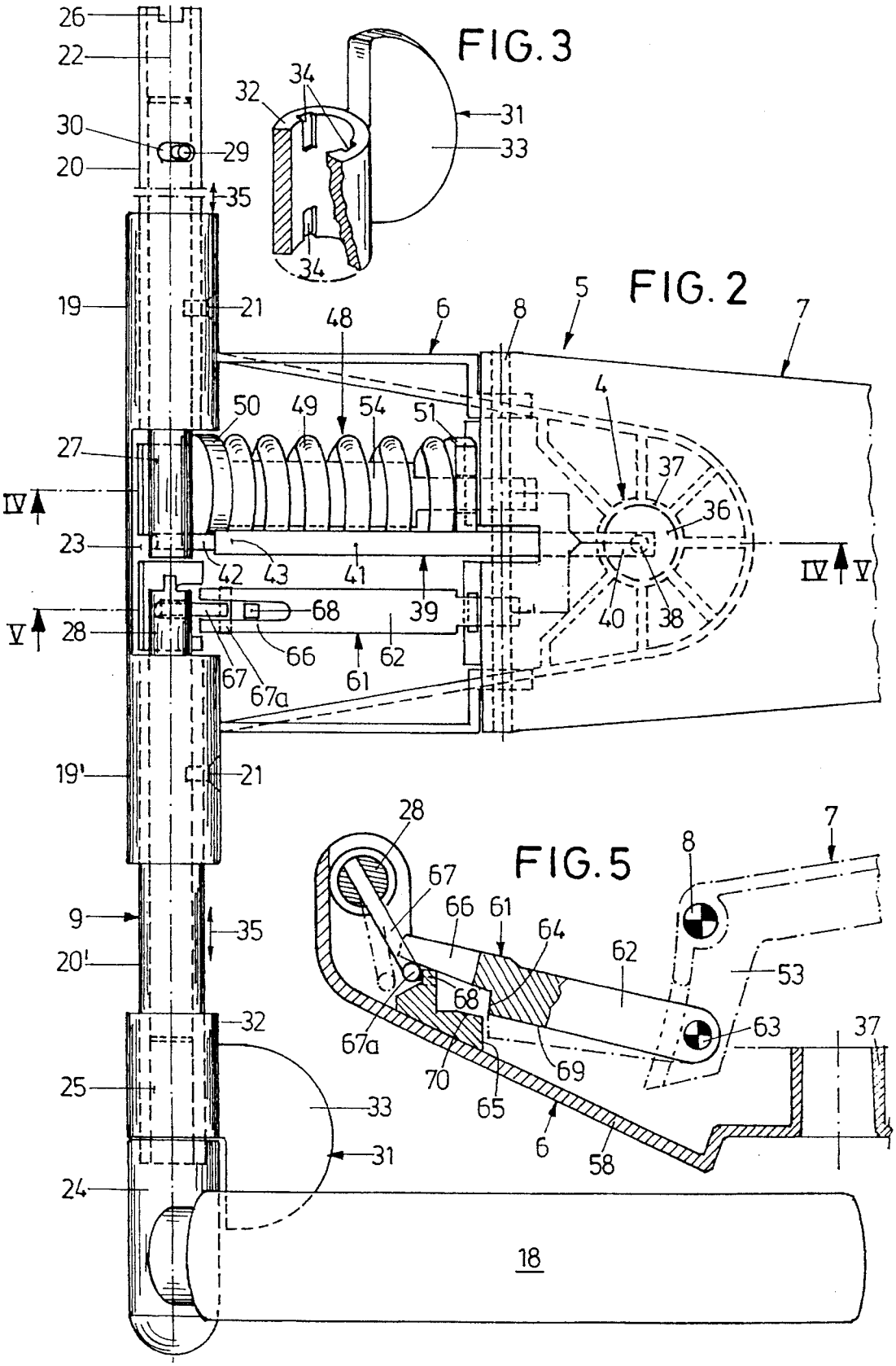
FIG. 2 is a partial plan view of a seat support of the chair of FIG. 1.
FIG. 3 is a perspective view of an operating lever for the chair.
FIG. 5 is a partial vertical section through the chair in accordance with the line V—V of FIG. 2.

As seen in FIG. 2, two bearing bushes 19, 19' in alignment with each other are formed in one piece with the front seat support member 6; two suspension tube sections 20, 20' forming the suspension tube 9 are positioned in alignment with each other in the bearing bushes 19, 19' and retained non-rotatably by means of a screw 21 and non-displaceably in the direction of the axis 22 of the suspension tube 9. The suspension tube sections 20, 20' only project outwards beyond the bearing bushes 19, 19'. Between the bearing bushes 19, 19'—and thus between the suspension tube sections 20, 20'—there is a substantially open chamber 23.

It is also roughly outlined in FIG. 2, bottom, that the armrest 18 is provided at its lower end with a short retaining socket 24 which is placed on to the end of the suspension tube section 20'. A retaining pin 25 engaging with the suspension tube section 20' is formed in the retaining socket 24 and joined to the latter. A screw not shown in the drawing is provided for arresting the retaining socket 24 in the direction of the axis 22. Positioning projections not shown in the drawing, which engage with recesses formed on the end of the respective suspension tube section 20, are formed in the retaining socket 24 as a safeguard against rotation of the armrest 18 in relation to the axis 22.

One acutating shaft, of which one end projects into the open chamber 23, is positioned pivotably about the axis 22 in each suspension tube section 20, 20'. An actuating shaft 27 for the height adjustment of a chair is located in the suspension tube section 20 shown in FIG. 2, top, whereas an actuating shaft 28 for actuating a synchronous mechanism is positioned in the suspension tube section 20' shown in FIG. 2, bottom. Each actuating shaft 27, 28 has at least one driving pin 29 extending radially to the axis 22 and passing outwards through an oblong hole 30 in the respective suspension tube section 20 and 20'. The respective oblong hole 30 covers part of the circumference of the respective suspension tube section 20, 20', the circumferential extension of the respective oblong hole 30 simultaneously defining the maximum pivot angle of the actuating shaft 27 and 28, respectively, about the axis 22. FIG. 2 illustrates only one driving pin 29 and one oblong hole 30.

The pivoting of the actuating shafts 27, 28 is effected by means of an operating lever 31 having a plug-in socket 32 and an actuating handle 33 arranged on the latter. Prior to the assembly of the armrest 18 on the suspension tube the tubular plug-in socket 32 is placed on the corresponding suspension tube section 20 and 20', respectively, recesses 34 formed on the inside of the plug-in socket 32 engaging with the driving pin 29. The configuration of the operating lever 31 is to be seen from FIG. 3. As seen in FIGS. 2 and 3, the actuating handle 33 projects on one side from the plug-in socket 32 referred to the axis 22. Since recesses 34 are formed on either side of the plug-in socket 32, the latter can be placed on the suspension tube section 20' such that the operating lever 31 projects outwards in the direction towards the armrest 18, as seen in FIG. 2, bottom. If—as seen in FIG. 2, top—no armrest 18 is to be provided, then the operating lever 31 can be placed on the suspension tube section 20 such that the actuating handle 33 projects in the direction towards the adjacent bearing bush 19. In this case, the front end of the respective suspension tube section 20 having the recesses 26 only has to be closed with a covering cap. As seen in FIG. 2, bottom, a portion of the respective suspension tube section 19 and 20 forming a bearing section 35 is left free between the respective bearing bush 20' or the adjacent plug-in socket 32. As still to be shown below, the seat 10 is being pivotably supported on these bearing portions.

Figure 4:
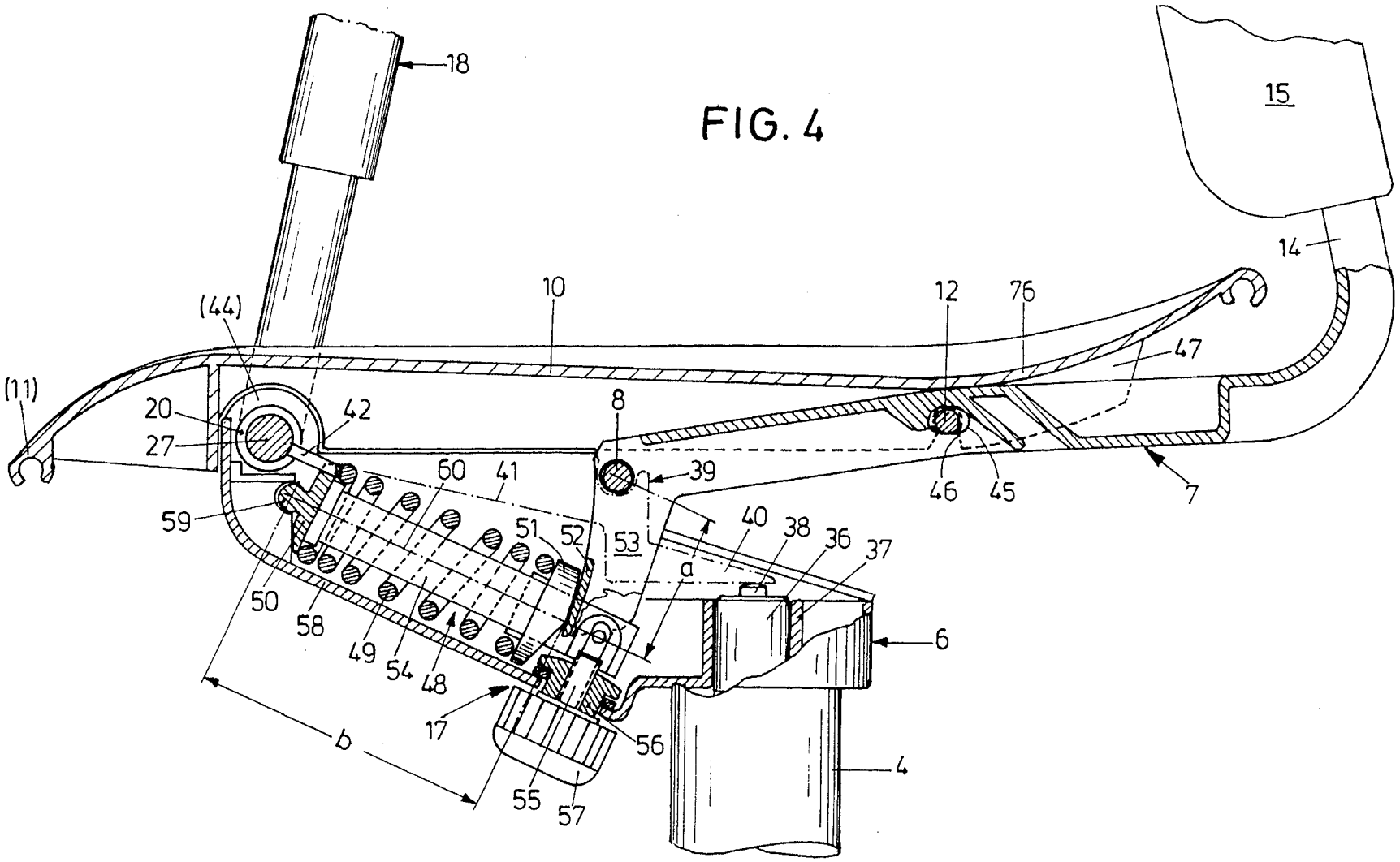
FIG. 4 is a partial vertical section through the chair in accordance with the line IV—IV of FIG. 2.

For the adjustment in height of the seat support 5 together with the seat 10 and the back 15, the chair column 4 has a longitudinally adjustable gas spring 36 generally known, which is clampingly retained in a clamping device 37 in the form of a cone, of the front seat support member 6. A valve control pin 38 projects upwards from the gas spring 36, which when pushed into the gas spring 36, opens a valve provided there, thereby ensuring longitudinal adjustments of the gas spring 36. Gas springs of this type are generally known in practice and have been shown and specified in U.S. Pat. No. 3,656,593. A two-armed valve control lever, which—as seen in FIG. 4—supports itself pivotably on the pivot axle 8, is provided for the actuation of this pin 38. One lever arm 40 of the lever 39 bears against the valve control pin 38, while the other lever arm 41 ends in the vicinity of the open chamber 23. This is where a valve control arm 42 projecting from the actuating shaft 27 approximately radially to the axis 22 is arranged on the actuating shaft 27 for the height adjustment of the seat, and that on the section of the actuating shaft 27 extending into the open chamber 23. The free end of the valve control arm 42 engages from below the adjacent free end of the lever arm 41, so that for any pivoting of the actuating shaft such that the free end 43 is pivoted upwards, the lever arm 40 of the lever 39 is pivoted downwards, pushing the valve actuating pin 38 into the gas spring 36. This pivoting operation is counterclockwise in FIG. 4. Whenever the user releases the actuating handle 33, the pin 38 is restored by the gas pressure in the gas spring 36, whereby the lever 39 and consequently the actuating shaft 27 are restored into the initial position.

As indicated above, the seat 10 is elastically locked in place on the suspension tube section 20, 20' by means of locking sections 44 which partially encase the bearing sections 35. This is feasible without any difficulty, the seat 10 and the locking sections 44 being made in one piece of hard elastic plastics. The locking sections 44 are shown in particular in FIG. 6. The rear portion of the seat 10 is supported on the supporting axle 12 which is positioned in oblong holes 45 extending approximately horizontally in the rear seat support member 7 and which extends in parallel to the axis 22 and to the pivot axle 8. The seat 10 is locked into place on this supporting axle 12 by means of snap-in holes 46 formed in webs 47 of the seat 10 extending downwards from the latter. Whenever the seat 10 is pivoted about the axis 22 of the front bearing sections 35 upon the pivoting of the rear seat support member 7 about the pivot axle 8, i.e. when the seat's rear portion is raised or lowered, then the oblong hole 45 in the rear seat support member 7 ensures the substantially horizontal relative motions occurring for any such raising or lowering, between the seat 10 and the rear seat support member 7 by the supporting axle 12 performing these motions in the oblong holes 45. When the rear seat support member 7 is pivoted about the pivot axle 8, the back 15 is pivoted in accordance with the pivoting motions of the rear seat support member 7. On the other hand, the seat 10 is pivoted about the stationary axis 22 by reason of the substantially vertical pivoting motions of the supporting axle 12 positioned in the rear seat support member 7. As a result of the geometric relations apparent from FIGS. 1, 4, 6, of the horizontal distances of the axis 22 relative to the pivot axle 8, to the supporting axle 12 and to the back-rest 15, the latter is pivoted by three to four times the angular measure as compared with the seat 10 when the rear seat support member is pivoted.

The pivoting described above, of the synchronous mechanism is encountered by an energy storing device 48, which is a prestressed helical compression spring 49 in the example of embodiment shown. By way of a pivotable abutment 50, this helical compression spring 49 supports itself on the front seat support member 6 under the actuation shaft 28 in the open chamber 23. The other end of the compression spring 49 is supported on guide shoe 51 of the force variation equipment 17. The guide shoe 51 rests on a slide face 52 formed on a lever arm 53 of the rear seat support member 7. This lever arm 53 is formed in one piece with the rear seat support member and extends from the pivot axle 8 substantially downwardly. In this regard, the rear seat support member is geometrically formed as an angle lever. The pivotable abutment 50 is provided with a rod 54 passing through the compression spring 49, on which also the guide shoe 51 is displaceable in the direction of the compression spring 49. The force variation equipment 17 engages on the end opposite to the abutment 50, of the rod 54. It has an adjusting screw 55 articulated on the rod 54 and engaging with an adjusting nut 56 which is configured as a part of a turning handle 57 and positioned rotatably but non-displaceably in the direction of the adjusting screw 55 in a lower wall 58 of the front seat support member 6. Consequently, upon rotation of the turning handle 57 with the adjusting nut 56, the adjusting screw 55 together with the rod 54 is pivoted on the pivot hinge 59, by way of which the pivotable abutment 50 supports itself on the front seat support member 6. Upon this, the guide shoe 51 is displaced on the sliding face 52 of the lever arm 53, whereby the distance of the axis 60 of the energy storing device 48 from the pivot axle 8 is changed. Since the sliding face 52 lies at least approximately on a segment of the arc of a circle, of which the center is formed by the pivot hinge 59, the distance b between the pivot hinge 59 and the point where the axis 60 passes through the slide face 52 is not or only slightly changed by rotation of the turning handle 57, so that the prestressing of the helical compression spring is not influenced by such adjustments.

So, the force exercised by the compression spring 49 on the lever arm 53 is not changed; it is only the effective lever arm, i.e. the overall torque exercised by the compression spring 49 on rear seat support portion 7 and thus on the seat and the back 15, that is changed by the modification of the distance a between the axis 60 and the pivot axle 8. This torque is the smaller, the smaller the distance a and vice versa. Thus, even the adjusting forces to be applied to the turning handle 57 can be kept constant along the entire adjusting path of the guide shoe 51, the frictional forces between the guide shoe 51 and the slide face 52 practically remaining unchanged.

A blocking mechanism 61 is provided to preclude the above-described pivotability of the seat 10 in common with the back 15 against the force of the compression spring 49. This blocking mechanism 61 substantially illustrated in FIGS. 2 and 5 has a blocking lever 62, which is arranged on the lever arm 53 of the rear seat support member 7 by means of a pivot joint 63 and which is pivotable about an axis parallel to the pivot axle 8. The pivot joint 63 is situated in the lower portion of the lever arm 53, i.e. it has a distinct distance from the pivot axle 8. On its bottom the blocking lever 62 is provided with a stop face 64 which is approximately perpendicular to the longitudinal direction of the blocking lever 62 and to which a stationary blocking face 65 is assigned. This blocking face 65 is formed on the front seat support member 6 in the vicinity of the latter's lower wall 58. The blocking face 65 faces the pivot joint 63, whereas the stop face 64 faces the blocking face 65. Opposite the pivot joint 63, the blocking lever 62 has a forked end 66, to which a blocking actuator arm 67 applies from below which is T-shaped and tightly joined to the actuating shaft 28. Consequently, a transverse web 67*a* of the actuator arm 67 engages the forked end 66 from below. From the section located in the open chamber 23, of the actuating shaft 27, the actuator arm 67 projects in the radial direction towards the axis 22. The blocking actuator arm 67 is pivoted from a postion shown in solid lines into a position shown in dash-dotted lines in FIG. 5 by the pivoting of this actuating shaft 28, which has been specified above for the actuating shaft 27. In the position shown in solid lines in FIG. 5, the blocking actuator arm 67 lifts the blocking lever 62 such that the latter's stop face 64 is disengaged from the blocking face 65. If the user of the chair forces the back 15 rearwards against the force of the compression spring 49, then the forked end 66 of the blocking lever 62 can be moved on the T-shaped actuator 67 in the direction towards the actuating shaft 27. Free balancing of the synchronous mechanism is possible. When, however, the actuating pin 28 is pivoted by means of the operating lever 31 into the position shown in dash-dotted lines in FIG. 5, then the transverse web 67*a* of the T-shaped actuator arm 67 is no longer in engagement with the forked end 66 so that the latter can slip over a guide pin 68 joined to the blocking face 65. However, this pivoting down of the blocking lever 62 is only possible when the rear seat support member 7 is pivoted by the force of the compression spring 49—the back 15 and the seat 10 being correspondingly relieved—into a position in which the back 15 takes its front end position and the seat 10 takes its upper end position. In these positions, the distance of the pivot joint 63 from the blocking face 65 is such as to allow the blocking lever 62 to move into a lower position of blocking shown in dash-dotted lines in FIG. 5. Therefore, any blocking of the rear seat support member 7 in relation to the front seat support member 6 and thus any fixing of the back 15 and the seat 10 in one position each is only possible in this specified position. When the relieved blocking lever 62 is moved essentially in its longitudinal direction by the pivoting of the rear seat support 7, then its bottom 69 slips over a support face 70 of the front seat support member 6 formed between the blocking face 65 and the guide pin 68.

Figure 6:
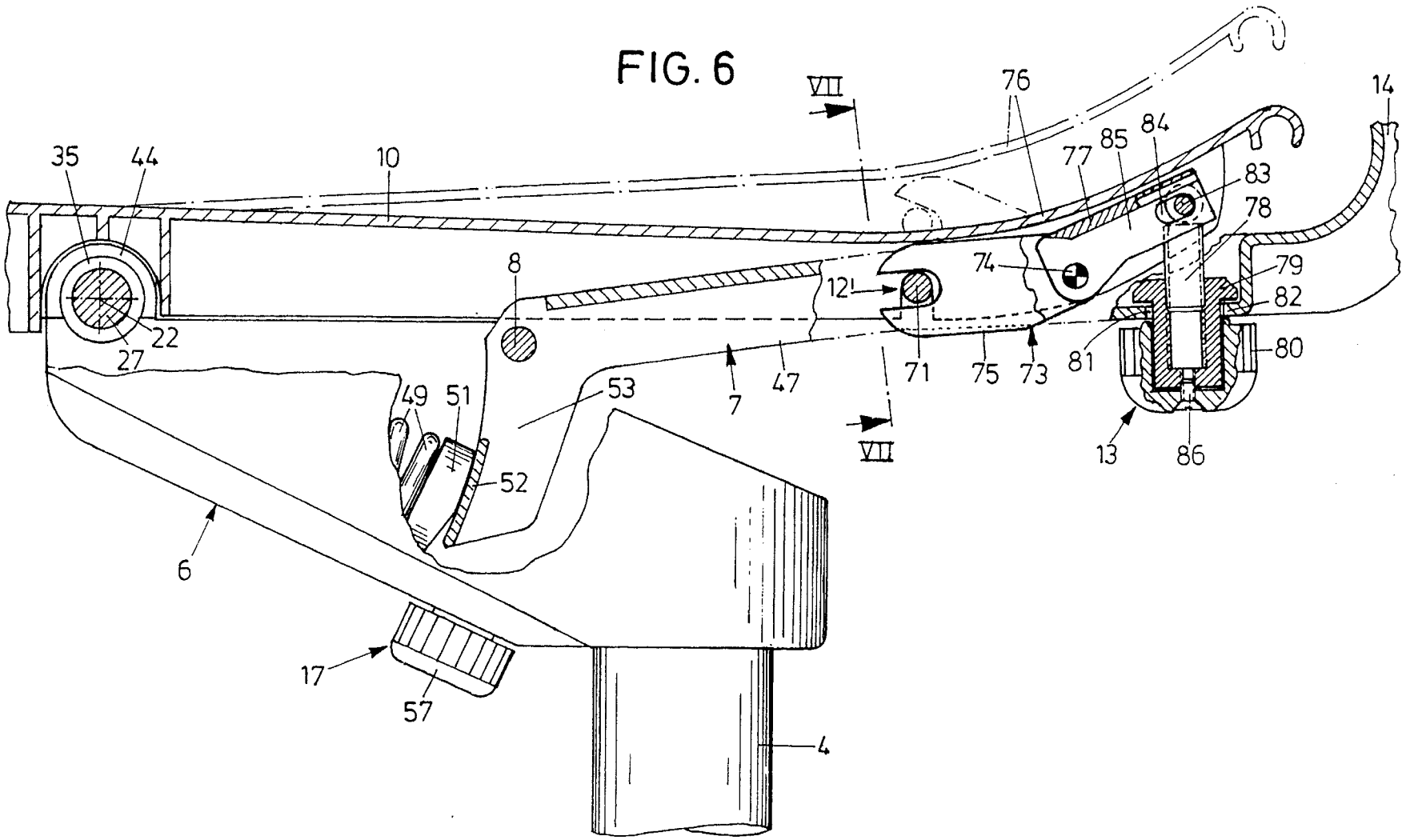
FIG. 6 is a partial vertical section through the seat of the chair, a seat pitch adjuster being illustrated.
Figure 7:
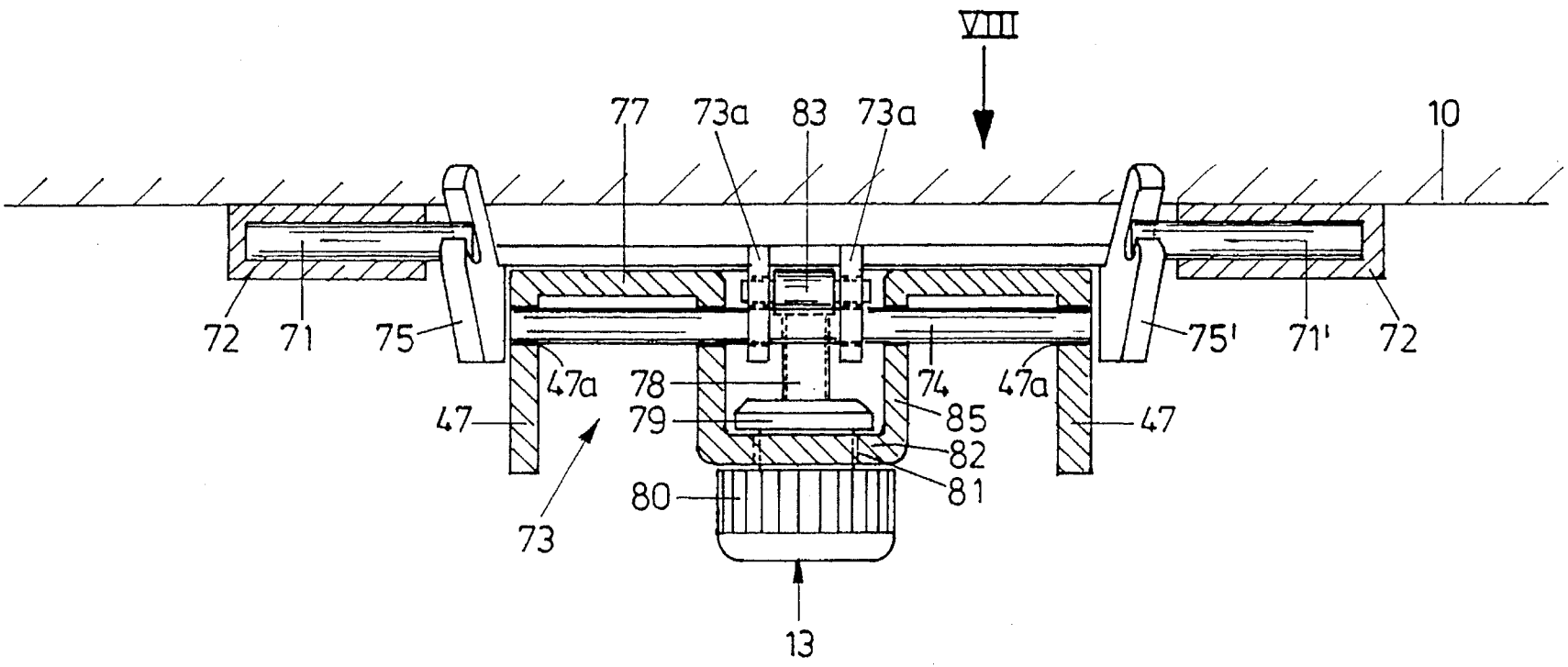
FIG. 7 is a partial vertical cross-section through the chair in accordance with the line VII—VII of FIG. 6.
Figure 8:
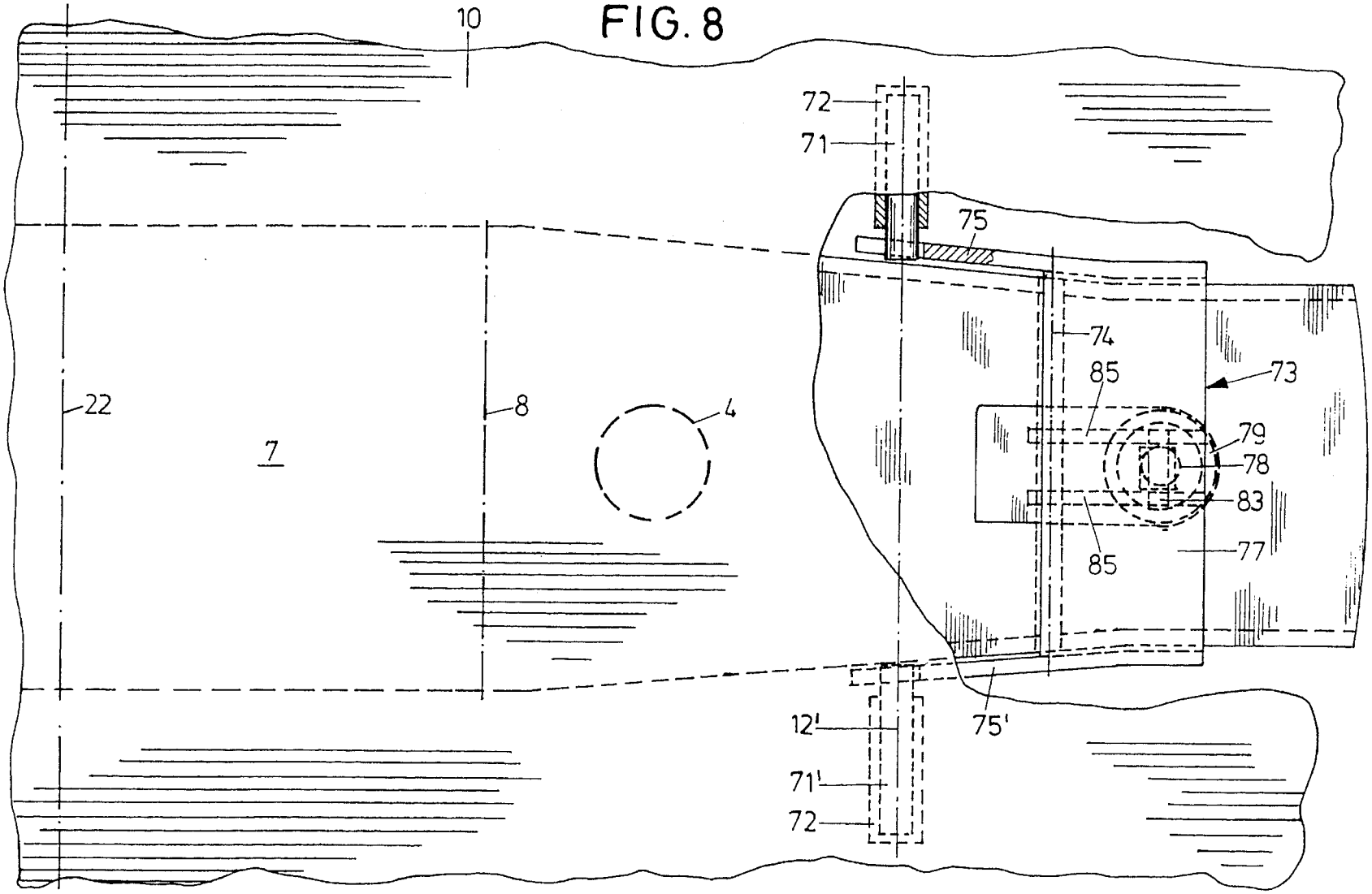

Unlike the support of the seat 10 by way of the supporting axle 12 which is substantially stationary relative to the rear seat support member 7, the basic adjustment of the seat pitch can also be varied by the possible alternative of a seat pitch adjuster 13 substantially shown in FIGS. 6 to 8. In this case, there is no continuous rod-shaped supporting axle 12, but the supporting axle 12' is fomed by two pins 71, 71' clampingly retained in bearing elements 72 on the bottom of the seat 10 so that they can be mounted even subsequently and, if necessary, removed without the seat 10 being destroyed. As seen in FIGS. 7 and 8, they are situated on either side of the rear seat support member 7 so that they can be pivoted past the latter's webs 47.

A balance 73 in the form of a double-armed lever is positioned on the seat support member 7 to be pivotable about a pivot axle 74. The pivot axle 74 is inserted into openings 47*a* in the webs 47 of the rear seat support member 7. It further passes through web-like bearing cheeks 73*a* formed on the bottom facing the rear seat support member 7, of the balance 73. The pivot axle 74 can be retained clampingly in the webs 47 and in the web-like bearing cheeks 73*a*, respectively. The balance 73 has two forked lever arms 75, 75' likewise located on either side of the rear seat support member 7 and gripping over a pin 71 and 71', respectively, so that the pins 71, 71' vary in height when the balance 73 is pivoted about the pivot axle 74 parallel to the pivot axle 8. As a result, given an otherwise fixed position of the rear seat support member 7 relative to the front seat support member 6, i.e. without any simultaneous adjustment of the position of the back 15, the seat 10 is pivoted about the axis 22 so that its rear portion 76 takes a higher or lower position relative to the rear seat support member 7. This pivoting of the balance 73 is realized in a similar way as the pivoting of the compression spring 49 of the force variation equipment 17.

An adjusting screw 78 engaging with an adjusting nut 79 is articulated on the plate-shaped lever arm 77 opposite to the forked lever arms 75, 75', of the balance 73. The adjusting nut 79 is tightly joined to a turning handle 80 which together with the adjusting nut 79 is supported rotatably but non-displaceably in the direction of the adjusting screw 78 in an opening 81 of a wall 82 of the rear seat support member 7. On its end opposite to the adjusting nut 79, the adjusting screw 78 has a transverse web 83 engaging with oblong holes 84 of abutment webs 85 of the lever arm 77. Upon rotation of the turning handle 80 the adjusting screw 78 is screwed into or out of, the adjusting nut 79, which results in the balance 73 being correspondingly pivoted about the pivot axle 74, the lowermost basic adjustment of the seat 10 to be achieved in this way being shown in solid lines and the highest possible basic adjustment being shown in dash-dotted lines in FIG. 6.

When the seat pitch adjuster 13 is installed as a possible accessory part—subsequently, as the case may be—then the adjusting nut 79 is inserted from above through the opening 81 in the wall 82 and the turning handle 80 is placed from below; both parts are then assembled by means of a screw 86. Further, the pins 71, 71' are pushed or forced into the bearing elements 72. The balance 73 is joined to the rear seat support member 7 by the pivot axle 74 being inserted. Further, the supporting axle 12 is removed from the oblong holes 45. The pins 71, 71' are then inserted in the forked lever arms 75, 75'. Subsequently, the seat 10 is joined to the front suspension tube 9 in that the locking sections 44 elastically lock into place on the suspension tube sections 20, 20', on which they are pivotable about the axis 22. The dismantling takes place correspondingly.

What is claimed is:

1. A chair, in particular an office chair, comprising:

a pedestal (2);

a chair column (4) projecting upwards from the pedestal (2);

a front seat support member (6) fixed to the chair column (4);

a rear seat support member (7) joined to the front seat support member (6) by a pivot axle (8);

a seat (10) pivoted on the front seat support member and supported on the rear seat support member (7);

a back-rest (15) secured to the rear seat support member (7);

an energy storing device (48), having a first end positioned on the front seat support member (6) and having another end distal to the first end positioned on the rear seat support member (7) at a distance (a) from the pivot axle (8);, and a blocking mechanism (61) for arresting the rear seat support member (7) in relation to the front seat support member (6);

wherein the seat (10) is supported in relation to the rear seat support member (7) by a supporting rod (12') which is adjustable in height relative to the rear seat support member (7) by means of a seat pitch adjuster (13).

2. A chair, in particular an office chair, comprising:

a pedestal (2);

a chair column (4) projecting upwards from the pedestal (2);

a front seat support member 6 fixed to the chair column (4);

a rear seat support member (7) joined to the front seat support member (6) by a first pivot axle (8);

a seat (10) pivoted on the front seat support member and supported on the rear seat support member (7);

a back-rest (15) secured to the rear seat support member (7);

an energy storing device (48), having a first end positioned on the front seat support member (6) and having another end distal to the first end positioned on the rear seat support member (7) at a distance (a) from the first pivot axle (8); and a blocking mechanism (61) for arresting the rear seat support member (7) in relation to the front seat support member (6);

wherein the seat (10) is supported in relation to the rear seat support member (7) by a supporting rod (12') which is adjustable in height relative to the rear seat support member (7) by means of a seat pitch adjuster (13); and wherein the seat pitch adjuster (13) has a double-armed lever (73), having a first arm and a second arm, which is supported on the rear seat support member (7) pivotably about a second pivot axle (74) and of which one of selectively the first arm and the second arm (75,75') is coupled with a supporting axle (12') and to the other lever arm (77) of which a pivoting device (78,79) is coupled which is joined to the rear seat support member (7).

3. A chair according to claim 2, wherein the double-armed lever is a balance (73).

4. A chair according to claim 2, wherein the one arm of the double-armed lever (73) is formed by at least one forked lever arm (75, 75') accommodating the supporting axle (12').

5. A chair according to claim 4, wherein the first arm and the second arm of the double-armed lever (73) are forked and are situated on either side of the rear seat support member (7) and with each of which the supporting axle (12') secured to the seat (10) engages.

6. A chair according to claim 2, wherein the pivoting device has an adjusting nut (79) and an adjusting screw (78) engaging with the latter, one of which is supported on the rear seat support member (7) rotatably but non-displaceably in its longitudinal direction and of which the other engages with the other lever arm (77) of the double-armed lever (73).

7. A chair according to claim 6, wherein the adjusting nut (79) is positioned on the rear seat support member (7).

8. A chair, in particular an office chair, comprising:

a pedestal (2);

a chair column (4) projecting upwards from the pedestal (2);

a front seat support member (6) fixed to the chair column (4);

a rear seat support member (7) joined to the front seat support member (6) by a pivot axle (8);

a seat (10) pivoted on the front seat support member and supported on the rear seat support member (7);

a back-rest (15) secured to the rear seat support member (7);

an energy storing device (48), having a first end positioned on the front seat support member (6) and having another end distal to the first end positioned on the rear seat support member (7) at a distance (a) from the pivot axle (8); and a blocking mechanism (61) for arresting the rear seat support member (7) in relation to the front seat support member (6);

wherein the seat (10) is supported in relation to the rear seat support member (7) by a supporting rod (12') which is adjustable in height relative to the rear seat support member (7) by means of a seat pitch adjuster (13); and wherein the seat pitch adjuster (13) is releasably mounted on the rear seat support member (7) and wherein the seat (10) is alternatively supported in relation to the rear seat support member (7) by way of a supporting axle (12) positioned in the latter.

9. A chair according to claim 8, wherein the supporting axle (12) located in the rear seat support member (7) is located in at least one oblong hole (45) in the rear seat support member (7).

10. A chair according to claim 9, wherein the seat (10) is joined to the supporting axle (12) by means of a locking assembly (46).

11. The chair according to claim 8, wherein the seat pitch adjuster (13) has a double-armed lever (73), having a first arm and a second arm, which is supported on the rear seat support member (7) pivotably about a pivot axle (74) and of which one of selectively the first arm and the second arm (75,75') is coupled with the supporting axle (12') and to the other lever arm (77) of which a pivoting device (78,79) is coupled which is joined to the rear seat support member (7).

12. The chair according to claim 11, wherein the double-armed lever is a balance (73).

13. The chair according to claim 11, wherein the one arm of the double-armed lever (73) is formed by at least one forked lever arm (75,75') accommodating the supporting axle (12').

14. A chair according to claim 13, wherein the first arm and the second arm of the double-armed lever (73) are forked and are situated on either side of the rear seat support member (7) and with each of which the supporting axle (12') secured to the seat (10) engages.

15. The chair according to claim 11, wherein the pivoting device has an adjusting nut (79) and an adjusting screw (78) engaging with the latter, one of which is supported on the rear seat support member (7) rotatably but non-displaceably in its longitudinal direction and of which the other engages with the other lever arm (77) of the double-armed lever (73).

16. A chair according to claim 15, wherein the adjusting nut (79) is positioned on the rear seat support member (7).

* * * * *